United States Patent [19]

Frank

[11] 4,259,917

[45] Apr. 7, 1981

[54] FOLDABLE MAST ASSEMBLY

[76] Inventor: Richard J. Frank, 1372 39th Ave. N.E., St. Petersburg, Fla. 33703

[21] Appl. No.: 964,209

[22] Filed: Nov. 28, 1978

[51] Int. Cl.[3] ..... B63B 15/00

[52] U.S. Cl. ..... 114/91

[58] Field of Search ..... 114/39, 90, 91; 52/298, 52/720, 721

[56] References Cited

U.S. PATENT DOCUMENTS

| | | | |
|---|---|---|---|
| 477,477 | 6/1892 | Uhlig | 114/91 |
| 3,507,240 | 4/1970 | Butler | 114/39 |
| 3,768,426 | 10/1973 | Kratz | 114/39 |
| 3,795,216 | 3/1974 | MacPherson | 114/39 |
| 3,827,386 | 8/1974 | Faden | 114/91 |
| 3,898,948 | 8/1975 | Huff | 114/91 |
| 4,016,823 | 4/1977 | Davis | 114/90 |
| 4,112,861 | 9/1978 | Lewis | 114/91 |
| 4,149,482 | 4/1979 | Hoyt | 114/90 |

*Primary Examiner*—Sherman D. Basinger

*Attorney, Agent, or Firm*—Brady, O'Boyle & Gates

[57] ABSTRACT

A foldable mast assembly for sailboats wherein a main mast is pivotably connected to a stub mast which is pivotally connected to a base secured to the sailboat deck. A removable pin extends between the stub mast and base whereby the main mast and stub mast may be folded to an inoperative position substantially parallel to the main deck and centered approximately lengthwise of the sailboat. The folding and raising of the main and stub masts are controlled by a cable reeved through sheaves carried on the main and stub masts, one end of the cable being connected to the fore deck near the bow of the sailboat and the other end connected to a power winch on the aft deck of the sailboat. In smaller sailboats, having small masts where cables and sheaves are not required, the folding and raising of the main and stub masts can be accomplished manually.

7 Claims, 9 Drawing Figures

FOLDABLE MAST ASSEMBLY

BACKGROUND OF THE INVENTION

Various attempts have been made to provide boats, such as sailboats, with masts foldable to an inoperative position to allow the boat to sail beneath relatively low bridges, and to facilitate the transporting of the boat by a trailer and the storage thereof. Some of these attempts are disclosed in U.S. Pat. Nos. 3,507,240; 3,768,426 and 3,827,386.

After considerable research and experimentation, the foldable mast assembly of the present invention has been devised whereby the mast may be folded to the inoperative position with very little effort, and characterized by having few moving parts and which is not likely to get out of order even after long and continued use.

The foldable mast assembly of the present invention comprises, essentially, a main mast pivotally connected to a stub mast which is pivotally connected to a base secured to the boat deck. A removable pin extends between the stub mast and the base whereby the main mast and stub mast may be folded relative to each other to an inoperative position substantially parallel to the main deck and centered approximately lengthwise of the boat. The folding and raising of the main and stub masts may be controlled by a cable reeved through sheaves carried on the main and stub masts, one end of the cable being connected to an eyelet secured to the deck in proximity to the bow, and the other end of the cable being connected to a power winch mounted on the boat deck in proximity to the stern. In smaller sailboats, having small masts where cables and sheaves are not required, the folding and raising of the main and stub masts can be accomplished manually.

By the construction and arrangement of the foldable mast assembly of the present invention, when folding the mast to an inoperative position, the main mast is caused to pivot to a horizontal position in a direction toward the boat stern, and the stub mast is then caused to pivot in a direction toward the bow of the boat whereby in the folded position, a portion of the main mast extends beyond the bow of the boat to thereby reduce the amount of mast projecting beyond the stern to thereby facilitate the transportation of the boat by a trailer and the storage thereof. Also, when using the foldable mast of the present invention, on sailboats requiring fore and aft stays, as well as shrouds, it is only necessary to disconnect the fore stay and any shrouds which are fastened forward of the base of the mast preparatory to folding the mast.

DESCRIPTION OF THE PREFERRED EMBODIMENT

Figure 1:
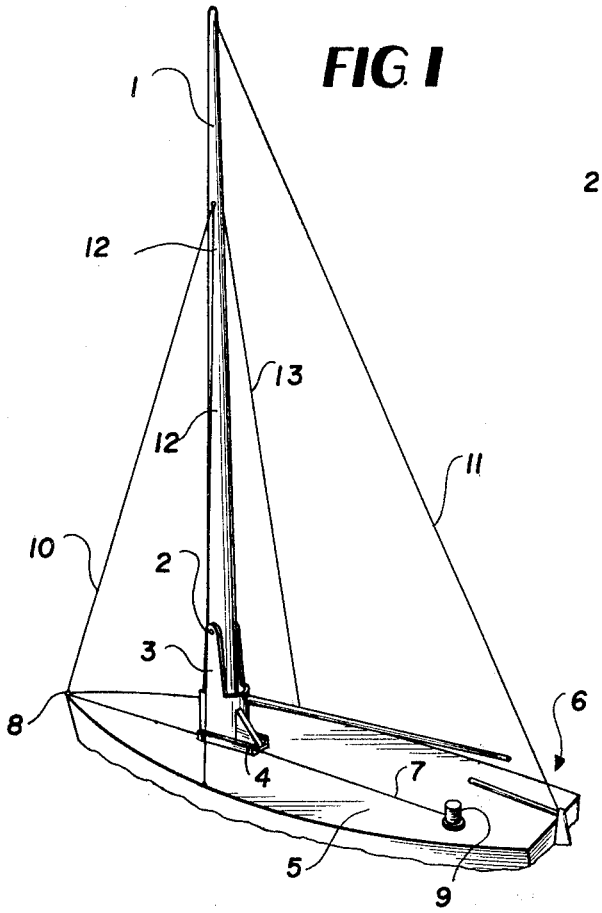
FIG. 1 is a perspective view of the foldable mast of the present invention in the raised position.
Figure 2:
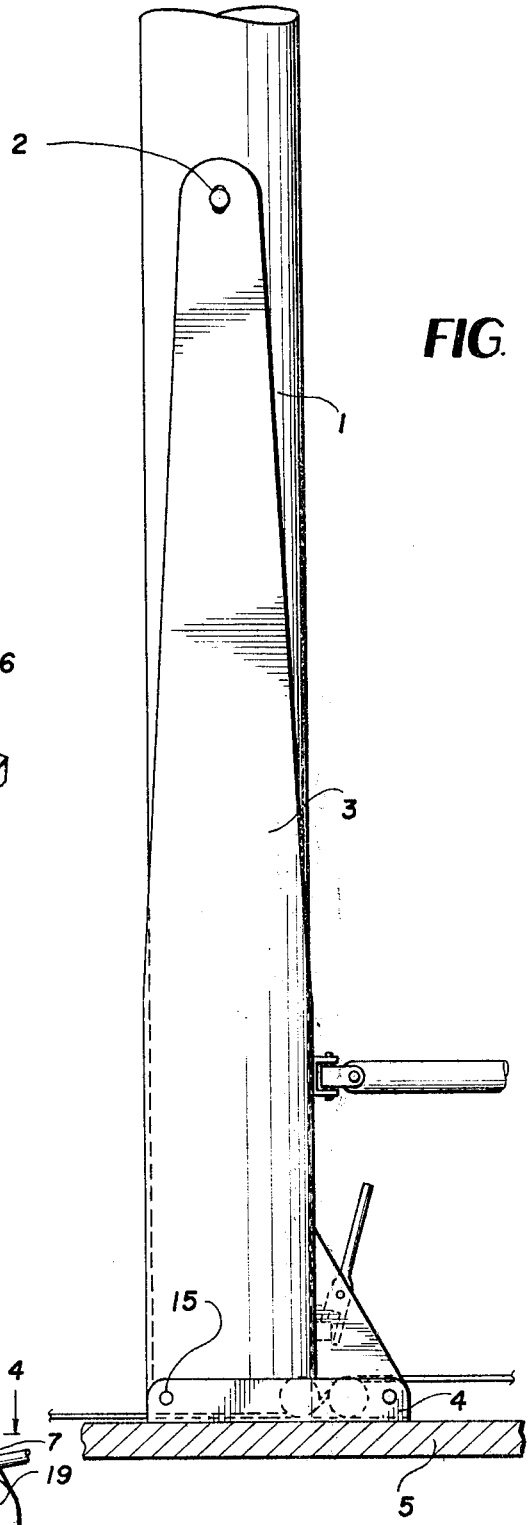
FIG. 2 is an enlarged, fragmentary, side elevational view of the base, stub mast and main mast in the raised or operative position.
Figure 3:
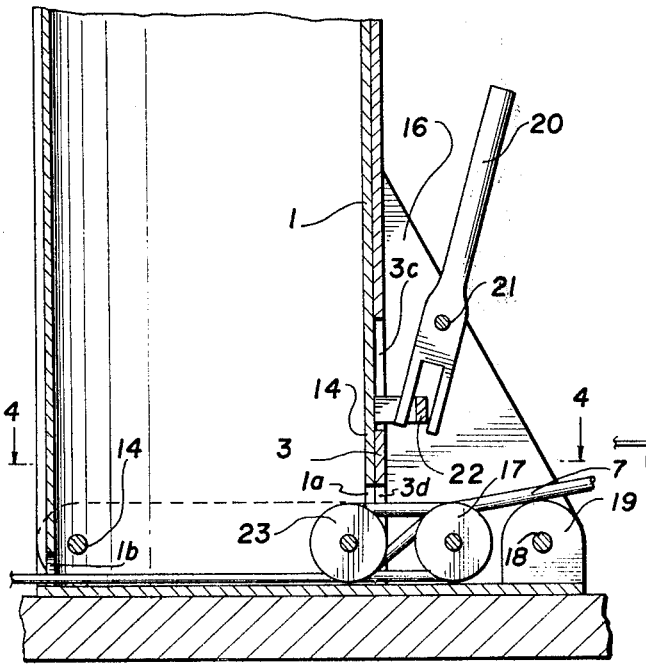
FIG. 3 is a fragmentary, sectional, side elevational view of the base, and the lower end portions of the main mast and stub mast in the operative position.
Figure 4:
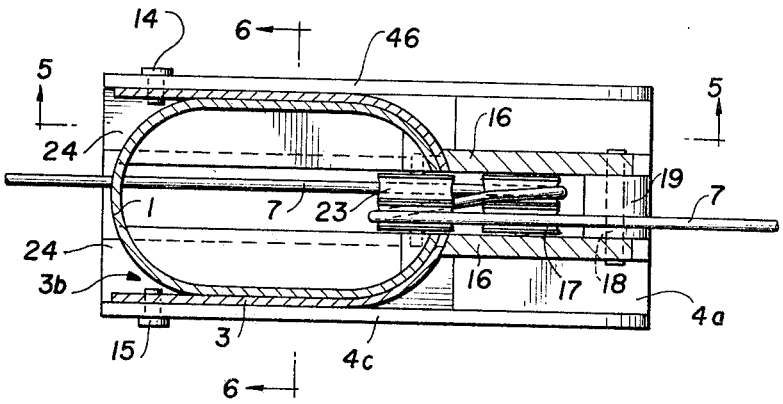
FIG. 4 is a view taken along line 4—4 of FIG. 3.
Figure 5:
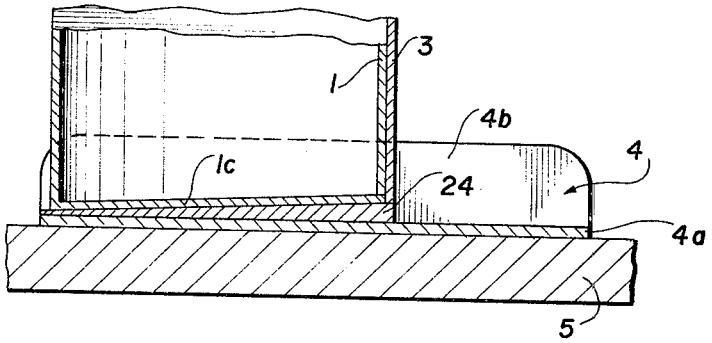
FIG. 5 is a view taken along line 5—5 of FIG. 4.
Figure 6:
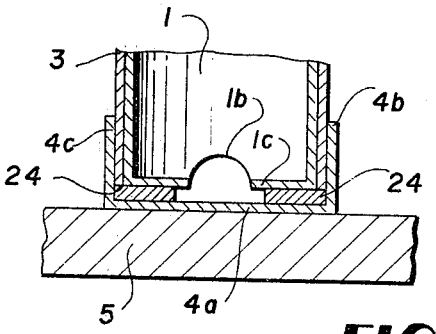
FIG. 6 is a view taken along line 6—6 of FIG. 4.

Referring to the drawings and more particularly to FIG. 1 thereof, the foldable mast assembly of the present invention comprises a main mast 1 pivotally connected as at 2 to a stub mast 3 which is pivotally connected to a base 4 secured to the deck 5 of a boat 6. The raising and lowering of the mast assembly is effected by a cable 7 reeved through sheaves carried by the main mast 1 and stub mast 3, to be described more fully hereinafter. One end of the cable is connected to a bow stay eye 8 and the other end is connected to a power winch 9. In sailboats requiring stabilization of the mast, conventional fore and aft stays 10 and 11 and shrouds 12 and 13 are provided.

The details of construction of the mast assembly are shown in FIGS. 2 to 6 wherein it will be seen that the base 4 comprises a channel member having a bottom wall 4*a*, and side walls 4*b* and 4*c*. The stub mast 3 is pivotally connected to the base 4 by pins 14 and 15 (FIG. 4) extending through the base side walls 4*b* and 4*c*, respectively. The stub mast 3 has a semitubular configuration being open on one side thereof as at 3*b* for receiving the main mast 1 in nested relationship therein, when the masts are in the operative position. A pair of spaced gusset plates 16 are secured to the side wall of the stub mast 3 at the lower end thereof and a sheave 17 is rotatably mounted between the plates. A removable locking pin 18 also extends between the spaced plates 16 and a portion 19 of the base plate whereby the stub mast 3 is held in the operative position relative to the base 4. In order to hold the main mast 1 in operative position relative to the stub mast 3, a bifurcated locking lever 20 is pivotally connected as at 21 to the gusset plates 16, the bifurcated end of the lever being engageable with a staple 22 integrally connected to the wall of the main mast 1 and extending through an elongated aperture 3*c* provided in the wall of the stub mast 3. Another sheave 23 is mounted within the main mast 1 adjacent the sheave 17, and as will be seen in FIG. 4, the cable 7 is suitably reeved through the sheaves 17 and 23 and extends from the eye 8 to the winch 9. As will be seen in FIGS. 3 and 4, the sheave 23 and associated cable 7 extend through apertures 1*a* and 3*d* provided in the lower end portions of the main and stub masts, respectively. A cut-out portion 1*b* (FIG. 6) is provided in the lower end portion of the main mast 1 to provide a fair lead for the forwardly extending portion of the cable.

On boats in excess of 30 feet, in order to stabilize the main mast 1 when mounted in the operative position, a pair of wedge plates 24 (FIGS. 5 and 6) are mounted on the bottom wall 4*a* of the base and are adapted to support the bottom wall 1*c* of the main mast 1. In order to accommodate the wedging action of the plates 24, the aperture through which the mast pivot pin 2 extends is elongated.

Figure 7:
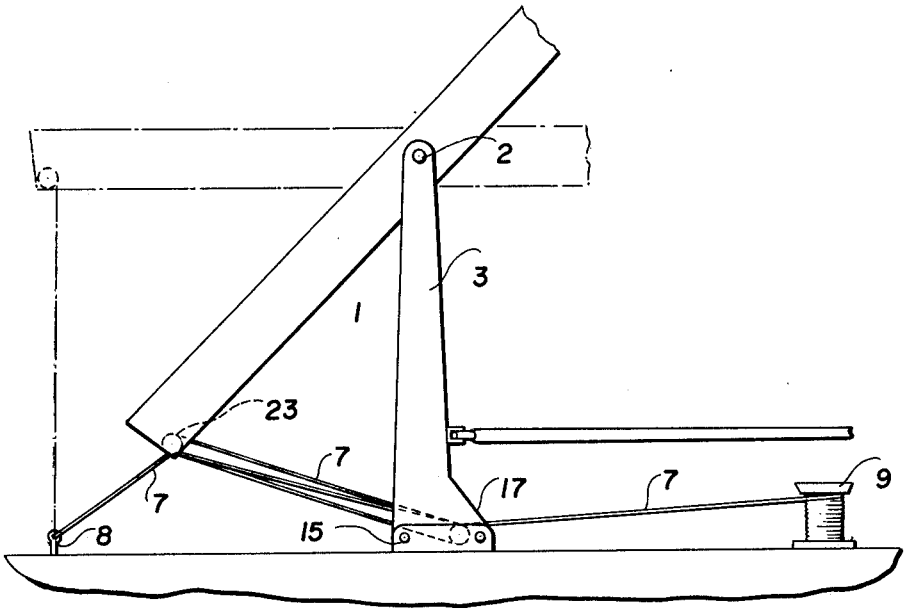
FIGS. 7 to 9 are side elevational views showing the mast assembly being folded to the inoperative position.
Figure 8:
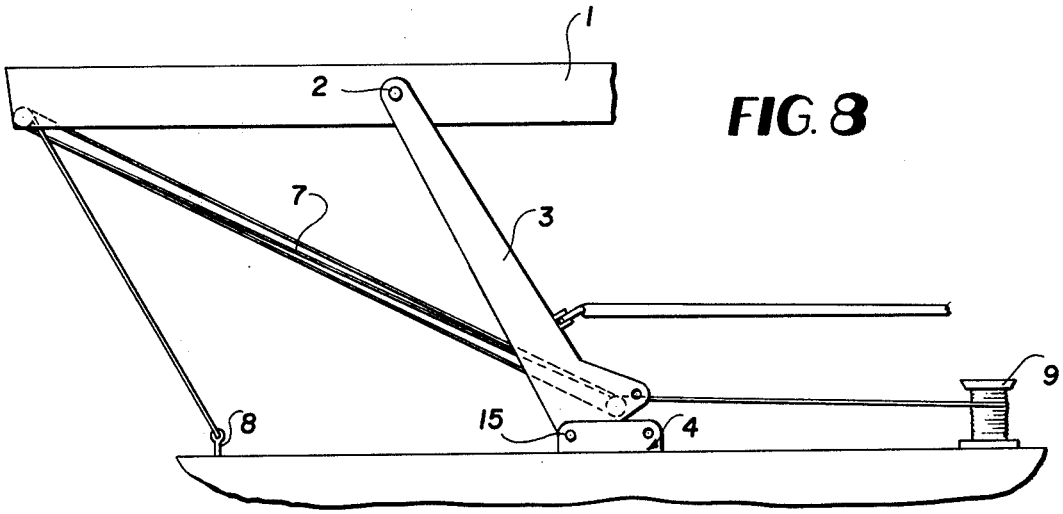
Figure 9:
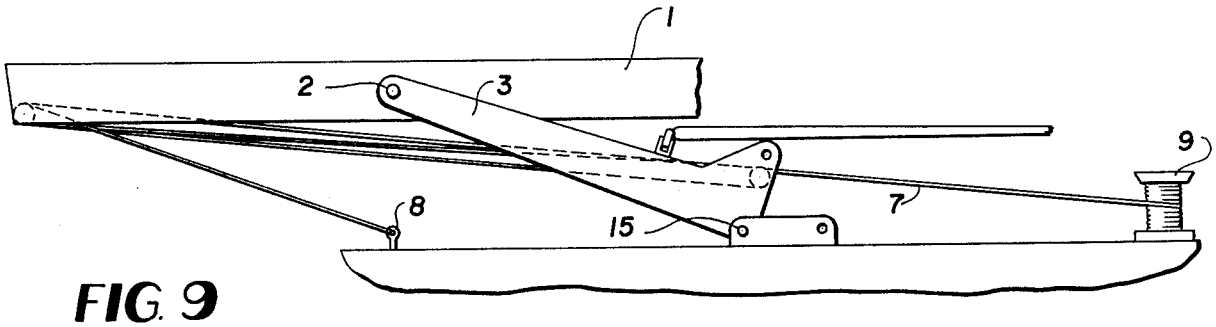

In the operation of folding the mast assembly from the operative position as shown in FIG. 1 to the folded, inoperative position as shown in FIG. 8, the fore stay 10 is disconnected; the lock lever 20 is then manually pivoted in a clockwise direction whereupon one of the logs of the bifurcated end of the lever 20 engages the lower edge of the staple 22 to slightly lift the main mast 1 from the wedge plates 24 the staple 22 being slidable upwardly in aperture 3*c*. The cable 7 is then unwound slowly from the winch 9 allowing the main mast 1 to pivot in a clockwise direction about pivot 2 until it is in a horizontal position as shown in phantom in FIG. 7. The pin 18 is then removed and the stub mast 3 pivots in a counterclockwise direction about pivot pins 14 and 15. The cable 7 is unwound from the winch 9 in a controlled manner to maintain tension on the cable 7 so that the main and stub masts are gradually moved to the folded position as shown in FIG. 8.

To unfold the mast assembly, the operation is reversed so that the cable 7 is wound onto the winch 9 to thereby pull the stub mast 3 to the erected position as shown in FIG. 7; at which time the pin 18 can be inserted. Further winding of the cable 7 pulls the main mast 1 to the erected position whereupon the lock lever 20 is actuated.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A foldable mast assembly comprising, a base, a stub mast, pivot means pivotally connecting said stub mast to said base, a main mast, pivot means pivotally connecting said main mast to said stub mast, first locking means interconnected between said base and said stub mast for holding said stub mast in a substantially vertical operative position, second locking means connected between the stub mast and main mast for holding the main mast in a substantially vertical, operative position, first sheave means mounted on the stub mast, second sheave means mounted on the main mast, a cable being reeved around said sheave means, one end of said cable being connected to a fixed support, and the opposite end of the cable being connected to a winch, whereby to fold the mast assembly to the inoperative position, said second locking means is first moved to the release position, the cable is unwound from said winch allowing said main mast to pivot to a horizontal position relative to the stub mast, said first locking means is then moved to the release position and the continued unwinding of the cable allows said stub mast to pivot to a substantially horizontal position relative to said base.

2. A foldable mast assembly according to claim 1, wherein said first locking means comprises a removable pin extending between said base and said stub mast.

3. A foldable mast assembly according to claim 1, wherein said stub mast is substantially tubular and being open on one side thereof for receiving the main mast in nested relationship when the mast assembly is in the operative position.

4. A foldable mast assembly according to claim 1, wherein the second locking means comprises a bifurcated lever pivotally connected to the stub mast, the bifurcated end of said lever being engageable with a staple connected to said main mast.

5. A foldable mast assembly according to claim 1, wherein the base comprises a channel member having a bottom wall and a pair of side walls, said stub mast pivot means comprising pin means extending between the side walls of said channel member and said stub mast.

6. A foldable mast assembly according to claim 5, wherein wedge means are mounted on the bottom wall of said channel, said main mast having a bottom wall engageable with said wedge means when said mast assembly is in the operative position.

7. A foldable mast assembly according to claim 1, wherein the base is mounted on the deck of a sailboat, said fixed support comprises a bow stay eye, and said winch being mounted aft of the mast assembly.

* * * * *